US006767596B2

(12) United States Patent
Hayakawa et al.

(10) Patent No.: US 6,767,596 B2
(45) Date of Patent: Jul. 27, 2004

(54) FILM SHEET FOR USE WITH OVERHEAD PROJECTORS

(75) Inventors: Kazuhisa Hayakawa, Niigata-ken (JP); Kazuto Kobayashi, Niigata-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 40 days.

(21) Appl. No.: 09/769,509

(22) Filed: Jan. 26, 2001

(65) Prior Publication Data

US 2001/0011062 A1 Aug. 2, 2001

(30) Foreign Application Priority Data

Jan. 28, 2000 (JP) ..... 2000-019414

(51) Int. Cl.[7] ..... B41M 5/40
(52) U.S. Cl. ..... 428/32.13; 428/32.14
(58) Field of Search ..... 428/32.13, 32.14, 428/195, 532, 323, 326, 332

(56) References Cited

U.S. PATENT DOCUMENTS

| | | | | | |
|---|---|---|---|---|---|
| 3,840,395 | A | * | 10/1974 | Koch | 117/144 |
| 3,899,452 | A | * | 8/1975 | Koch et al. | 260/2.5 B |
| 4,614,545 | A | * | 9/1986 | Hess | 106/169 |
| 5,166,333 | A | * | 11/1992 | Breckwoldt | 536/84 |
| 6,074,354 | A | * | 6/2000 | Scholz et al. | 602/6 |
| 6,146,770 | A | * | 11/2000 | Sargeant et al. | 428/500 |
| 6,238,804 | B1 | * | 5/2001 | Atherton et al. | 428/532 |
| 6,361,853 | B1 | * | 3/2002 | Shaw-Klein et al. | 428/195 |
| 6,550,966 | B1 | * | 4/2003 | Saad et al. | 383/103 |

FOREIGN PATENT DOCUMENTS

| | | |
|---|---|---|
| EP | 0947350 | 10/1999 |
| JP | 45-2116 | 1/1970 |
| JP | 61287782 | 12/1986 |
| JP | 62009988 | 1/1987 |
| JP | 11058936 | 3/1999 |
| WO | 98/32611 | 7/1998 |

OTHER PUBLICATIONS

Shin–Etsu Chemical Co., Ltd. web site (wysiwyg://115/http://www.metolose.jp/e/industrial/index.shtml.*

Susan Warren—Wall Street Journal; "Why Dow Chemical Finds Slime Sublime"; Nov. 15, 1999; p. B1.

Paul W. Morgan, "Determination of Ethers and Esters of Ethylene Glycol; A Modified Alkoxyl Analysis", Industrial and Engineering Chemistry, Analytical Edition, vol. 18, No. 8, pp. 500–504, Aug., 1946.

Wolfgang Merz, "Identifizierung und quantitave Bestimmung von Alkoxyl sowie Äthylen– und Propylenoxid in monomolekularer und polymerer Form", Analytical Chemistry, vol. 232, pp. 82–93, Jul. 3, 1967.

* cited by examiner

*Primary Examiner*—B. Shewareged
(74) *Attorney, Agent, or Firm*—Foley & Lardner LLP

(57) ABSTRACT

The present invention provides transparent film sheets for use in projection by an OHP which can be used both in dry copying and in the ink-jet printing of characters and/or pictures, can be directly printed with a jet printing ink without the intervention of a layer receptive to the jet printing ink, can be disposed of in a state capable of maintaining secrecy after use without the necessity of being shredded, and can be disposed of as a class of recycling waste like common white paper. Specifically, the present invention provides transparent film sheets formed of a cellulose ether derived from cellulose which is the basic component of common paper.

18 Claims, No Drawings

FILM SHEET FOR USE WITH OVERHEAD PROJECTORS

BACKGROUND OF THE INVENTION

1. Field of the Invention

This invention relates to film sheets for use in projection by an overhead projector (hereinafter abbreviated as "OHP") which is used in a meeting, conference or the like.

2. Description of the Related Art

As transparent film sheets for use with OHPs, transparent film sheets formed of polyesters such as polyethylene terephthalate are being widely used.

These polyester films have surface properties and heat-resisting properties which permit characters and/or pictures to be easily printed thereon by dry copying techniques such as xerography and, moreover, have high strength and excellent shelf stability.

In recent years, the spread of personal computers has made it easy to prepare materials for presentation in a conference or meeting. In particular, even diversely colored materials may be easily prepared.

Recently, there are some cases in which materials prepared with a personal computer are used for purposes of presentation by direct projection by a liquid crystal projector or the like. However, it is still common practice to prepare materials for use with an OHP by printing colored materials on common white paper with a printer of the ink-jet printing type and then copying them onto special-purpose polyester film sheets by means of a color copying machine, or by printing characters and/or pictures directly on such polyester film sheets by means of a printer designed for direct printing thereon. The reason for this is that polyester film sheets cannot be directly printed with a jet printing ink. Recently, a multilayer transparent film obtained by forming a polyvinyl alcohol-containing layer receptive to a jet printing ink over a polyester film is available. This film makes it possible to prepare materials for use with an OHP directly by means of an ink-jet printer which is less expensive than color copying machines.

As described above, such films formed of a polyester alone have high transparency and excellent shelf stability. However, when it is desired to dispose of the films having become unnecessary after use, highly secret materials must be treated by shredding or the like. Thus, they must be disposed of in a way different from recycling waste such as materials prepared from common white paper.

SUMMARY OF THE INVENTION

The present invention has been made in view of the above-described circumstances, and an object of the present invention is to provide transparent film sheets for use in projection by an OHP which can be used both in dry copying and in the ink-jet printing of characters and/or pictures, can be directly printed with a jet printing ink without the intervention of a layer receptive to the jet printing ink, can be disposed of in a state capable of maintaining secrecy after use without the necessity of being shredded, and can be disposed of as a class of recycling waste like common white paper.

As a result of intensive investigations carried out with a view to solving the above-described problems, the present inventors have now found that film sheets formed of a cellulose ether derived from cellulose which is the basic component of common paper can be printed with characters and/or pictures by means of either an ink-jet printer or a dry copying machine, are not liable to curling during use, enable the projection of sharp images because of direct printing with a jet printing ink without the intervention of a layer receptive to the jet printing ink, and are stable because of their low hygroscopicity. The reason why the OHP film sheets formed of a cellulose ether can be directly subjected to ink-jet printing is believed to be that a cellulose ether generally has a surface-active effect owing to the balance between the ether substituent groups and the hydrophilic and hydrophobic groups inherently present in the molecule of the cellulose and, therefore, a film formed of the cellulose ether exhibits an improvement in the adhesion of an ink. Moreover, it has also been found that, when the sheets have become unnecessary after use, they can be dipped in water to make the printed characters and/or pictures undiscernible, and then disposed of, and that the sheets can be disposed of as a class of combustible or recycling waste like paper, because an aqueous solution of a water-soluble cellulose does not constitute a source for BOD (biochemical oxygen demand) upon disposal. The present invention has been completed on the basis of these findings.

The OHP film sheets of the present invention can be printed with characters and/or pictures by means of either an ink-jet printer or a dry copying machine, are not liable to curling during use, enable the projection of sharp images because of direct printing with a jet printing ink without the intervention of a layer receptive to the jet printing ink, and are stable because of their low hygroscopicity. Moreover, since cellulose which is the basic component of paper is used as a raw material, the sheets which have become unnecessary after use can be dipped in water to make the printed characters and/or pictures undiscernible, and then disposed of. On that occasion, the sheets can be disposed of as a class of combustible or recycling waste like paper, because an aqueous solution of a water-soluble cellulose does not constitute a source for BOD upon disposal. Furthermore, conventional OHP film sheets are inconvenient in that only the surface-treated side must be chosen and used. In contrast, the OHP film sheets of the present invention have the advantage that either side may be chosen and used, depending on the manner of use.

DETAILED DESCRIPTION OF THE PREFERRED EMBODIMENTS

The present invention is more specifically described hereinbelow. However, it is to be understood that the present invention is not limited to the embodiments described below.

Preferred examples of the cellulose ether used in the present invention include, but are not limited to, alkylcelluloses such as water-soluble methylcellulose (MC); hydroxyalkyl alkylcelluloses such as hydroxypropyl methylcellulose (HPMC), hydroxyethyl methylcellulose (HEMC) and hydroxyethyl ethylcellulose (HEEC); hydroxyalkyl celluloses such as hydroxypropyl cellulose (HPC) and hydroxyethyl cellulose (HEC); and carboxymethylcellulose sodium (CMC-Na). There may be used any cellulose ether that is derived by etherifying cellulose to make it water-soluble and can be formed into a film by casting an aqueous solution thereof to a certain thickness and then drying it.

Specifically, useful alkylcelluloses include, for example, methylcellulose having 19 to 33% by weight of the methoxyl group, and ethylcellulose having 7 to 25% by weight of the ethoxyl group.

Useful hydroxyalkyl alkylcelluloses include, for example, hydroxypropyl methylcellulose having 19 to 30% by weight of the methoxyl group and 13 to 20% by weight of the hydroxypropoxyl group, hydroxyethyl methylcellulose having 19 to 30% by weight of the methoxyl group and 9 to 20% by weight of the hydroxyethoxyl group, and hydroxyethyl ethylcellulose having 11 to 21% by weight of the ethoxyl group and 40 to 57% by weight of the hydroxyethoxyl group.

Useful hydroxyalkyl celluloses include, for example, hydroxypropyl cellulose having 50 to 70% by weight of the hydroxypropoxyl group, and hydroxyethyl cellulose having 30 to 60% by weight of the hydroxyethoxyl group.

A useful example of carboxymethylcellulose sodium (CMC-Na) is that having 15 to 53% by weight of the carboxymethoxyl group.

The contents of the methoxyl, ethoxyl, hydroxypropoxyl and like groups can be determined according to the methods described in the Pharmacopoeia of Japan. On the other hand, the content of the hydroxyethoxyl group can be determined according to the method described in P. W. Morgan, Eng. Chem. Anal. Ed., 1946, 18, pp. 500–504 or in Merz, Z. Anal. Chem., 1967, 232, pp. 82–93.

The film prepared from a cellulose ether according to the present invention needs to have high transparency. If its transparency is low, the film will have a problem in that the images projected by an OHP may not be sharp. Such a cellulose ether may be prepared by mixing cellulose with NaOH or the like to form a homogeneous alkali cellulose, and reacting it with an etherification reagent until a degree of ether substitution required to making it water-soluble is achieved.

If the cellulose ether has an insufficient degree of substitution or is not uniformly substituted, a lot of undissolved fibrous matter having a length of 8 to 200 $\mu$m will remain when it is dissolved in water.

The amount of such undissolved fibrous matter may be determined by dissolving the cellulose ether in ISOTON II (an aqueous electrolyte solution for use with Coulter counters; manufactured by Coulter, Inc.) within a thermostatic chamber at 20° C. so as to give a 0.1 wt % aqueous solution, and counting the number of undissolved fibers present in 2 ml of the solution and having a length of 8 to 200 $\mu$m by means of a Model TAII Coulter Counter (manufactured by Coulter, Inc.) or multisizer using an aperture tube having a diameter of 400 $\mu$m.

For a cellulose ether capable of forming a film with which very sharp images can be projected when it is used for purposes of projection by an OHP, it is preferable that the number of undissolved fibers determined in the above-described manner be not greater than 1,000 (inclusive of zero).

Preferably, the cellulose ether used in the present invention is characterized in that, when 100 g of the cellulose ether is shaken on a sieve having an opening of 150 $\mu$m, the amount of cellulose ether remaining on the sieve is not greater than 25% by weight. If the amount is greater than 25% by weight, the solubility of the cellulose ether may be reduced to cause an increase in the amount of undissolved fibers and, therefore, the transparency of the resulting film sheet may be reduced.

Specifically, using a Model 429 Low-Tap Sieve Shaker (manufactured by Kansai Kana-Ami Co., Ltd.) fitted with a No. 100 standard sieve (having an opening of 150 $\mu$m) as prescribed by JIS Z8801, 100 g of the cellulose ether is shaken for 30 minutes under conditions including 200 shakes per minute, 156 strokes per minute, and an amplitude of 50 mm. Thereafter, the amount of residue on the sieve is weighed.

No particular limitation is placed on the molecular weight of the cellulose ether used. However, it is generally preferable that a 2 wt % aqueous solution of the cellulose ether have a viscosity of not less than 3 mPa.s at 20° C. This viscosity corresponds to a weight-average molecular weight of not less than 10,000 which can provide a film-forming ability. The aforesaid viscosity can be measured according to the viscosity measuring method described in the Pharmacopoeia of Japan.

A film of the cellulose ether described herein may be formed by casting a solution of the cellulose ether and then drying it, or by extruding a thick solution of the cellulose ether into a film and then drying it, as described in Japanese Patent Publication (JP-B) No. 45-2116/'70.

In the case of alkylcelluloses and hydroxyalkyl alkylcelluloses which are not soluble in water having a high temperature, films thereof may be formed by dispersing a powdered cellulose ether in hot water at a high concentration, casting this dispersion, cooling it to dissolve the cellulose ether, and then drying it to form a film.

No particular limitation is placed on the thickness of the OHP sheet of the present invention. However, if the sheet is unduly thin, it may have poor durability, and if the sheet is unduly thick, it may have low transparency and be hard to handle. Accordingly, its thickness is preferably in the range of 5 to 200 $\mu$m and more preferably about 10 to 100 $\mu$m.

Moreover, various additives may be added to the cellulose ether, so long as they do not interfere with the objects of the present invention and they permit the cellulose ether to be formed into a film. Such additives include inorganic fillers such as ceramics; colorants such as Food Red, Methyl Orange and Methyl Red; polyhydric alcohol type plasticizers and surfactants such as glycerol; organic binders such as polyvinyl alcohol, sodium polyacrylate and polyacrylamide; and the like.

The present invention is more specifically explained with reference to the following examples and comparative example. However, these examples are not to be construed to limit the scope of the invention.

EXAMPLE 1

A 3 wt % aqueous solution of hydroxypropyl methylcellulose (60SH-50; manufactured by Shin-Etsu Chemical Co. Ltd.) containing 29% by weight of the methoxyl group and 9% by weight of the hydroxypropoxyl group and having a viscosity of 50 mPa's as measured by a 2 wt % solution at 20° C. was prepared. This hydroxypropyl methycellulose is characterized in that the powder remaining on a sieve having an opening of 150 $\mu$m is 10% by weight when measured under the above-described conditions, and in that the number of undissolved fibers present in a 0.1 wt % aqueous solution is 600 when counted with a Coulter counter is described previously. 27 g of this solution was poured into a 30 cm×22 cm mold made of glass, and dried at 70° C. for 10 hours to form a film. The resulting 10 $\mu$m thick film was stripped from the mold.

This film was set on a BJC-35v Ink-Jet Printer (manufactured by Canon Inc.). Thus, numerical tables and graphs having red, yellow and blue colors were printed thereon and projected by an OHP. The projected images were sharp, and their definition was similar to that of images obtained by providing a sheet of white paper having characters and pictures printed thereon, copying them onto a polyester film by means of a dry color copying machine (PIXEL; manufactured by Canon Inc.), and projecting them.

Moreover, when a hydroxypropyl methylcellulose film formed in the above-described manner was used in place of the polyester film and subjected to dry color copying, the resulting sheet permitted similarly sharp images to be projected.

After projection, the sheets were dipped in water, so that the sheet surface was partially dissolved to make the printed images undiscernible. When the sheets were recovered from water and dried, they were wrinkled, but could be disposed of as a class of waste like newspapers.

EXAMPLE 2

A film was formed in the same manner as in Example 1, except that methyl cellulose having 29% by weight of the methoxyl group (manufactured by Shin-Etsu Chemical Co. Ltd.) was used. When characters and pictures printed thereon were projected by an OHP, the definition of the projected images was the same as that achieved in Example 1. Since the printed images became undiscernible in water as described in Example 1, the sheet could be directly disposed of.

EXAMPLE 3

A film was formed and evaluated in the same manner as in Example 1, except that hydroxypropyl cellulose having 65% by weight of the hydroxypropoxyl group (manufactured by Nippon Soda Co. Ltd. under the trade name of L) was used. The results of evaluation were the same as those of Example 1.

COMPARATIVE EXAMPLE 1

In the same manner as in Example 1, transparent films having a thickness of about 10 μm were formed from a 3 wt % aqueous solution of polyvinyl alcohol (PA05S; manufactured by Shin-Etsu Chemical Co. Ltd.) and used to print characters and pictures thereon. The sheets were greatly curled, whether characters and/or pictures were printed thereon by an ink-jet printer or by a dry color copying machine. Moreover, these sheets made it difficult to project sharp images by an OHP. Furthermore, when these sheets were allowed to stand, they became soft and showed an increase in stickiness, so that fingerprints tended to be left thereon during handling.

What is claimed is:

1. A film sheet adapted for use with overhead projectors comprising a cellulose either without intervention of a layer adapted to be receptive to a jet printing ink, wherein said cellulose ether is a cellulose ether that, in 2 ml of an aqueous solution obtained by mixing 0.1 part by weight of the cellulose ether with 99.9 parts by weight of water at 20° C., the number of undissolved fibers having a length of 8 to 200 μm is not greater than 1,000.

2. A film sheet for use with overhead projectors as claimed in claim 1, wherein the film sheet is adapted to receive ink directly from an ink-jet printer that directly prints at least one of characters and pictures thereon.

3. A film sheet for use with overhead projectors as claimed in claim 2 wherein said cellulose ether is characterized in that, in 2 ml of an aqueous solution obtained by mixing 0.1 part by weight of the cellulose ether with 99.9 parts by weight of water at 20° C., the number of undissolved fibers having a length of 8 to 200 μm is not greater than 1,000.

4. A film sheet adapted for use with overhead projectors comprising a cellulose either without intervention of a layer adapted to be receptive to a jet printing ink, wherein said cellulose ether is a cellulose ether that, when 100 g of the cellulose ether is shaken on a sieve having an opening of 150 μm, the amount of cellulose ether remaining on the sieve is not greater than 25% by weight.

5. A film sheet for use with overhead projectors as claimed in claim 2 wherein said cellulose ether is a cellulose ether that, when 100 g of the cellulose ether is shaken on a sieve having an opening of 150 μm, the amount of cellulose ether remaining on the sieve is not greater that 25% by weight.

6. A film sheet for use with overhead projectors as claimed in claim 1 wherein said cellulose ether is a cellulose ether that, when 100 g of the cellulose ether is shaken on a sieve having an opening of 150 μm, the amount of cellulose ether remaining on the sieve is not greater that 25% by weight.

7. A film sheet for use with overhead projectors as claimed in claim 3 wherein said cellulose ether is a cellulose ether that, when 100 g of the cellulose ether is shaken on a sieve having an opening of 150 μm, the amount of cellulose ether remaining on the sieve is not greater than 25% by weight.

8. A film sheet for use with overhead projectors as claimed in claim 2 wherein said cellulose ether is selected from the group consisting of alkylcelluloses, hydroxyalkyl alkylcelluloses, hydroxyalkyl celluloses and carboxymethylcellulose sodium.

9. A film sheet for use with overhead projectors as claimed in claim 1 wherein said cellulose ether is selected from the group consisting of alkylcelluloses, hydroxyalkyl alkylcelluloses, hydroxyalkyl celluloses and carboxymethylcellulose sodium.

10. A film sheet for use with overhead projectors as claimed in claim 3 wherein said cellulose ether is selected from the group consisting of alkylcelluloses, hydroxyalkyl alkylcelluloses, hydroxyalkyl celluloses and carboxymethylcellulose sodium.

11. A film sheet for use with overhead projectors as claimed in claim 4 wherein said cellulose ether is selected from the group consisting of alkylcelluloses, hydroxyalkyl alkylcelluloses, hydroxyalkyl celluloses and carboxymethylcellulose sodium.

12. A film sheet for use with overhead projectors as claimed in claim 5 wherein said cellulose ether is selected from the group consisting of alkylcelluloses, hydroxyalkyl alkylcelluloses, hydroxyalkyl celluloses and carboxymethylcellulose sodium.

13. A film sheet for use with overhead projectors as claimed in claim 6 wherein said cellulose ether is selected from the group consisting of alkylcelluloses, hydroxyalkyl alkylcelluloses, hydroxyalkyl celluloses and carboxymethylcellulose sodium.

14. A film sheet for use with overhead projectors as claimed in claim 7 wherein said cellulose ether is selected from the group consisting of alkylcelluloses, hydroxyalkyl alkylcelluloses, hydroxyalkyl celluloses and carboxymethylcellulose sodium.

15. An overhead projector transparency medium comprising:

an overhead projector transparency film sheet, wherein the film sheet is adapted to receive ink directly from an ink-jet printer, wherein the film sheet consists essentially of a cellulose ether, and wherein the film sheet consists of one layer, and wherein said cellulose either is a cellulose ether that when placed in 2 ml of an aqueous solution obtained by mixing 0.1 part by weight of the cellulose either with 99.9 parts by weight of water at 20 C., the number of undissolved fibers having a length of 8 to 200 μm is not greater that 1,000.

16. The overhead projector transparency medium of claim 15, wherein the transparency medium consists of one layer, the one layer being the same layer as the transparency film sheet.

17. The overhead projector transparency medium of claim 1, wherein the film sheet has at least one of characters and pictures thereon, the at least one of characters and pictures comprising dried or cured ink-jet ink.

18. The overhead projector transparency medium of claim 15, wherein the transparency medium consists of one layer, the one layer being the same layer as the film sheet, and wherein the film sheet has at least one of characters and pictures thereon, the at least one of characters and pictures comprising dried or cured ink-jet ink.

* * * * *